US006257138B1

(12) United States Patent
Bialek

(10) Patent No.: US 6,257,138 B1
(45) **Date of Patent: *Jul. 10, 2001**

(54) OFFSET PRINTING PRESS

(75) Inventor: Herbert Bialek, Neckargemünd (DE)

(73) Assignee: Heidelberger Druckmaschinen Aktiengesellschaft, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/128,808

(22) Filed: Aug. 4, 1998

(30) Foreign Application Priority Data

Aug. 4, 1997 (DE) ..... 197 33 693

(51) Int. Cl.[7] ..... B41F 9/00
(52) U.S. Cl. ..... 101/142; 101/147
(58) Field of Search ..... 101/142, 148, 101/425, 350.4, 352.01, 144, 348, 217, 218, 352

(56) References Cited

U.S. PATENT DOCUMENTS

| | | |
|---|---|---|
| 3,911,815 | 10/1975 | Banfer . |
| 4,290,360 | 9/1981 | Fischer . |
| 4,440,081 | 4/1984 | Beisel . |
| 4,724,764 | 2/1988 | MacPhee et al. . |
| 5,562,031 | 10/1996 | Garner et al. . |

FOREIGN PATENT DOCUMENTS

| | | |
|---|---|---|
| 22 21 423 | 5/1975 | (DE) . |
| 20 02 228 | 7/1980 | (DE) . |
| 29 32 105 | 2/1981 | (DE) . |
| 31 46 223 A1 | 6/1983 | (DE) . |
| 35 21 715 A1 | 2/1986 | (DE) . |
| 36 44 982 C2 | 1/1990 | (DE) . |
| 44 04 989 A1 | 8/1995 | (DE) . |
| 44 04 989 C2 | 11/1995 | (DE) . |
| 30 23 636 C2 | 5/1996 | (DE) . |
| 195 29 205 A1 | 2/1997 | (DE) . |
| 195 29 205 C2 | 8/1997 | (DE) . |

*Primary Examiner*—John S. Hilten
*Assistant Examiner*—Darius U. Cone
(74) *Attorney, Agent, or Firm*—Herbert L. Lerner; Laurence A. Greenberg; Werner H. Stemer

(57) ABSTRACT

An offset printing press having a plate cylinder and, as viewed in a direction of rotation of the plate cylinder, a first applicator roller assigned to a dampening unit and a second applicator roller to an inking unit, a bridge roller in contact with the first and second applicator rollers, and a roller in contact with the first applicator roller for selectively driving the first applicator roller at the circumferential speed of the plate cylinder and at a different speed, includes a drive connection of the bridge roller so formed that, when the first applicator roller is driven at a circumferential speed different from that of the plate cylinder, the bridge roller is drivable at the circumferential speed of the plate cylinder.

6 Claims, 1 Drawing Sheet

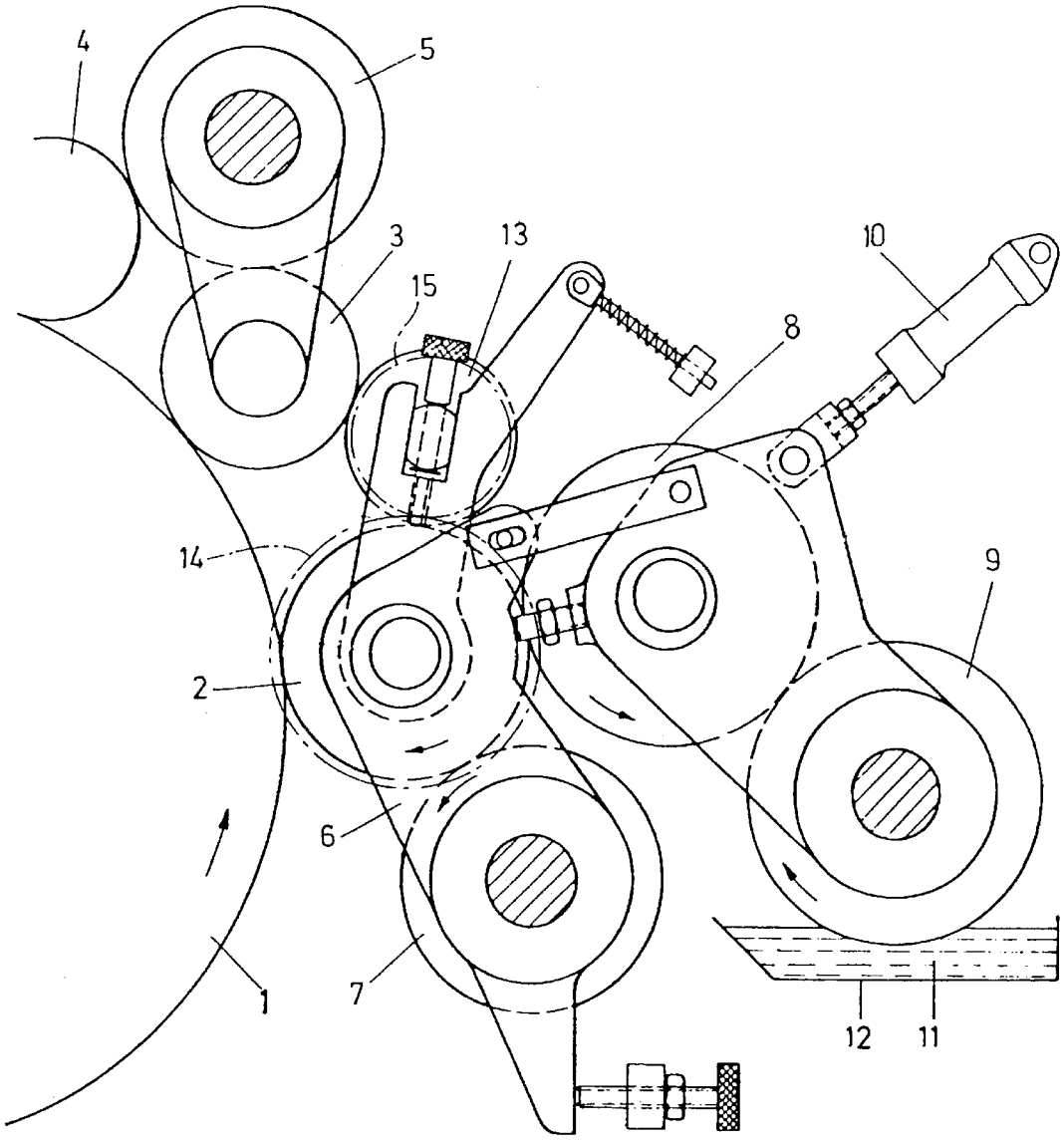
4
5
3
13
15
10
8
14
9
2
6
1
7
12
11

OFFSET PRINTING PRESS

BACKGROUND OF THE INVENTION

FIELD OF THE INVENTION

The invention relates to an offset printing press wherein, as seen in the direction of rotation of a plate cylinder, a first applicator roller is assigned to a dampening unit and a second applicator roller to an inking unit, a bridge roller is in contact with the first and second applicator rollers, and a roller is in contact with the first applicator roller for driving the first applicator roller at the circumferential speed of the plate cylinder or at a different speed.

In a conventional embodiment of this printing press generally known from U.S. Pat. No. 4,724,764, the first applicator roller, as seen in the direction of rotation of the plate cylinder, is driven at a different circumferential speed from the circumferential speed of the plate cylinder, the drive of the first applicator roller preferably effecting a lower circumferential speed. Dirt particles are thereby supposed to be removed from the printing plate due to the wiping effect which occurs. In this conventional construction, the bridge roller also is driven at a different circumferential speed from the circumferential speed of the plate cylinder, so that the second applicator roller, which rotates at the circumferential speed of the plate cylinder, may be braked by the bridge roller. This risk arises, in particular, in the vicinity of the cylinder gap, so that an inking fault may occur after the second applicator roller reengages the printing plate.

SUMMARY OF THE INVENTION

Proceeding from this state of the prior art, it is an object of the invention of the instant application, to provide an offset printing press wherein, during product-dependent supplying of dampening medium and removal of dirt particles from the printing plate, ghosting effects potentially producible by the first or second applicator roller are avoided.

With the foregoing and other objects in view, there is provided, in accordance with the invention, an offset printing press having a plate cylinder and, as viewed in a direction of rotation of the plate cylinder, a first applicator roller assigned to a dampening unit and a second applicator roller to an inking unit, a bridge roller in contact with the first and second applicator rollers, and a roller in contact with the first applicator roller for selectively driving the first applicator roller at the circumferential speed of the plate cylinder and at a different speed, comprising a drive connection of the bridge roller so formed that, when the first applicator roller is driven at a circumferential speed different from that of the plate cylinder, the bridge roller is drivable at the circumferential speed of the plate cylinder.

In accordance with another feature of the invention, the drive connection is between one of the applicator rollers and the bridge roller.

In accordance with another feature of the invention, the drive connection is decouplable when the first applicator roller is driven at the circumferential speed of the plate cylinder.

In accordance with a further feature of the invention, the drive connection comprises a pair of spur gears between the first applicator roller and the bridge roller.

In accordance with a concomitant feature of the invention, one of the spur gears of the pair of spur gears is mounted so as to be decouplable.

According to the invention, there is no differential speed between the bridge roller and the second applicator roller, so that ghosting effects or streaking on the printing plate are avoided. Moreover, there is a differential speed between the first applicator roller and the bridge roller, so that the formation of an emulsion between the dampening medium and ink is improved, and ghosting effects on the first applicator roller are eliminated. In this regard, the drive of the bridge roller may be derived from another roller of the dampening or inking unit or else directly from the printing-press drive. By this construction in accordance with the invention, therefore, dirt particles can be removed from the printing plate in a relatively simple manner, without adversely affecting the inking of the latter.

By the advantageous embodiment of the invention wherein a drive connection is provided between one of the applicator rollers and the bridge roller, it is possible to ensure that the bridge roller will always rotate at the circumferential speed of the plate cylinder, when the first applicator roller has, for example, a lower circumferential speed.

By the further advantageous embodiment of the invention wherein the drive connection is decouplable when the first applicator roller is driven at the circumferential speed of the plate cylinder, there is no differential speed between the participating rollers of the dampening and inking units, so that disturbances or faults are thereby avoided. By the additional advantageous embodiment of the invention wherein the drive connection is formed by a pair of spur wheels between the first applicator roller and the bridge roller, one spur wheel of the pair of spur wheels may be mounted so as to be decouplable, so that faults or malfunctions are avoidable rather simply during the operation of the offset printing press.

Other features which are considered as characteristic for the invention are set forth in the appended claims.

Although the invention is illustrated and described herein as embodied in an offset printing press, it is nevertheless not intended to be limited to the details shown, since various modifications and structural changes may be made therein without departing from the spirit of the invention and within the scope and range of equivalents of the claims.

BRIEF DESCRIPTION OF THE DRAWING

The construction and method of operation of the invention, however, together with additional objects and advantages thereof will be best understood from the following description of specific embodiments when read in connection with the accompanying single figure of the drawing, which is a diagrammatic side elevational view of an offset printing press embodying the invention.

DESCRIPTION OF THE PREFERRED EMBODIMENT

Referring now to the single figure of the drawing, there is shown therein, an offset printing press which, as viewed in the direction of rotation of a plate cylinder 1, is provided with a first applicator roller 2 assigned to a dampening unit, and second and third rollers 3 and 4, respectively, assigned to an inking unit, all of the applicator rollers 2, 3 and 4 being mounted in the offset printing press so as to be suitably engageable. In this regard, the applicator rollers 3 and 4 are engageable and disengageable with an ink distributor roller 5.

In the illustrated exemplary embodiment, the applicator roller 2 is mounted on a bearing plate 6 which is pivotable about a distributor roller 7. Furthermore, a metering roller 8, which is pivotable about a dipping roller 9, is engageable with the first applicator roller 2 via a pneumatic cylinder 10. In this regard, the dipping roller 9 dips into dampening medium 11 contained in a dampening-medium duct or fountain 12.

Between the first applicator roller 2 and the second applicator roller 3, there is provided a bridge roller 13 which is in contact with both rollers 2 and 3. In an advantageous embodiment, the first applicator roller 2 has a spur gear 14 assigned thereto, and the bridge roller 13 has a spur gear 15 assigned thereto. The two spur gears 14 and 15 are in meshing engagement with one another and determine the circumferential speed of the bridge roller 13. It is assumed, in this regard, that the first applicator roller 2 is frictionally driven, for example, by the distributor roller 7. If the first applicator roller 2 is driven, for example, at a lower circumferential speed than that of the plate cylinder 1, slippage and a wiping effect, respectively, occur therebetween. The difference in the two speeds may, for example, amount to 10%. In this case, the transmission ratio between the spur gears 14 and 15 is planned so that, taking into account the diameters of the rollers 2 and 13, this difference is compensated for, and the bridge roller 13 is driven at the circumferential speed of the plate cylinder 1, i.e., the spur gear 14 is larger than the spur gear 15 by this 10%. In this configuration, an advantageous wiping effect occurs between the first applicator roller 2 and the plate cylinder 1 and the bridge roller 13. The circumferential speed of the second applicator roller 3 and that of the bridge roller 13 are identical and correspond to the circumferential speed of the plate cylinder 1.

Should the first applicator roller 2 be driven by the distributor roller 7 at the circumferential speed of the plate cylinder 1, the drive connection between the first applicator roller 2 and the bridge roller 13 may be decoupled, an action which may be performed, for example, by axially displacing one of the two spur gears 14 or 15.

Instead of this operation in accordance with the invention, for example the connection between a spur gear 14 or 15 and the respective first applicator roller 2 or bridge roller 3, associated therewith, can also be released by a clutch or coupling. In this regard, the bridge roller 3 is driven frictionally by the two applicator rollers 2 and 3 at the circumferential speed of the plate cylinder 1. With this alternative operation in accordance with the invention, the pressman or press operator has a choice of reversing the drive of the distributor roller 7 in accordance with the respective printing job, so as to drive the first applicator roller 2 with identical or different speeds. According to the construction of the dampening unit, the drive of the first dampening applicator roller 2 may also be derived from another roller.

I claim:

1. An offset printing press having a plate cylinder and, as viewed in a direction of rotation of the plate cylinder, a first applicator roller assigned to a dampening unit and a second applicator roller to an inking unit, a bridge roller in contact with said first applicator roller and said second applicator roller, and a further roller in contact with said first applicator roller for selectively driving said first applicator roller at the circumferential speed of said plate cylinder and at a different speed, comprising:

a drive connection of a bridge roller;

a further roller connected to a first applicator roller;

said drive connection of said bridge roller being so formed that, when said first applicator roller is frictionally driven by said further roller at a circumferential speed different from that of a plate cylinder, said bridge roller is drivable at the circumferential speed of said plate cylinder; and said drive connection having a pair of spur gears between said first applicator and said bridge roller, wherein one of said spur gears of said pair of spur gears is connected to a clutch and is thereby decouplable.

2. The offset printing press according to claim 1, wherein said drive connection comprises a pair of spur gears between said first applicator and said bridge roller and the bridge roller.

3. An offset printing press having a plate cylinder and, as viewed in a direction of rotation of the plate cylinder, a first applicator roller assigned to a dampening unit and a second applicator roller to an inking unit, a bridge roller in contact with said first applicator roller and said second applicator roller, and a further roller in contact with said first applicator roller for selectively driving said first applicator roller at the circumferential speed of said plate cylinder and at a different speed, comprising:

a drive connection of a bridge roller;

a further roller connected to a first applicator roller;

said drive connection of said bridge roller being so formed that, when said first applicator roller is frictionally driven by said further roller at a circumferential speed different from that of a plate cylinder, said bridge roller is drivable at the circumferential speed of said plate cylinder; and said drive connection having a pair of spur gears between said first applicator and said bridge roller, said drive connection is decouplable when said first applicator roller is driven at the circumferential speed of said plate cylinder by axially displacing one of said spur gears.

4. An offset printing press having a plate cylinder and, as viewed in a direction of rotation of the plate cylinder, a first applicator roller assigned to a dampening unit and a second applicator roller to an inking unit, a bridge roller in contact with said first applicator roller and said second applicator roller, and a further roller in contact with said first applicator roller for selectively driving said first applicator roller at the circumferential speed of said plate cylinder and at a different speed, comprising:

a drive connection of a bridge roller;

a further roller frictionally connected only to a first applicator roller; and said drive connection of said bridge roller being so formed that, when said first applicator roller is frictionally driven by said further roller at a circumferential speed different from that of a plate cylinder, said bridge roller is drivable at the circumferential speed of said plate cylinder, said drive connection includes a pair of spur gears between the first applicator roller and the bridge roller, wherein one of the spur gears of said pair of spur gears is mounted so as to be decouplable.

5. The offset printing press according to claim 3, wherein said drive connection includes a pair of spur gears between the first applicator roller and the bridge roller.

6. The offset printing press according to claim 5, wherein one of the spur gears of said pair of spur gears is mounted so as to be decouplable.

* * * * *